US007714241B2

(12) United States Patent
Searle et al.

(10) Patent No.: US 7,714,241 B2
(45) Date of Patent: May 11, 2010

(54) SEALED EXTERIOR SWITCH

(75) Inventors: Gary M. Searle, Norfolk, MA (US); Art Stephen, Milton, MA (US); William Harrop, Stoughton, MA (US)

(73) Assignee: Stoneridge Control Devices, Inc., Canton, MA (US)

( * ) Notice: Subject to any disclaimer, the term of this patent is extended or adjusted under 35 U.S.C. 154(b) by 999 days.

(21) Appl. No.: 11/265,524

(22) Filed: Nov. 2, 2005

(65) Prior Publication Data

US 2006/0163048 A1 Jul. 27, 2006

Related U.S. Application Data

(60) Provisional application No. 60/624,396, filed on Nov. 2, 2004.

(51) Int. Cl.
*H01H 9/04* (2006.01)

(52) U.S. Cl. ..... 200/302.1; 200/302.3

(58) Field of Classification Search ..... 200/302.1, 200/302.2, 302.3
See application file for complete search history.

(56) References Cited

U.S. PATENT DOCUMENTS 5,412,169 A 5/1995 Comerci et al.
5,430,261 A 7/1995 Malone
5,448,028 A 9/1995 Filion et al.
5,772,767 A * 6/1998 Chambers et al. ..... 118/428
5,990,431 A * 11/1999 Wright ..... 200/302.3
6,573,466 B1 * 6/2003 Rapp et al. ..... 200/302.3
6,794,592 B1 * 9/2004 Liu et al. ..... 200/302.3
6,956,180 B1 * 10/2005 Su et al. ..... 200/302.3
7,145,091 B1 * 12/2006 Wang ..... 200/302.3

OTHER PUBLICATIONS

International Search Report with Written Opinion dated Sep. 19, 2006 received in corresponding International Patent Application Serial No. PCT/US05/40254.

* cited by examiner

*Primary Examiner*—Michael A Friedhofer
*Assistant Examiner*—Lheiren Mae A Anglo
(74) *Attorney, Agent, or Firm*—Grossman, Tucker, Perreault & Pfleger, PLLC

(57) ABSTRACT

A switch assembly may include a housing having a body and an over-molded feature. The over-molded feature may include a flexible membrane sealingly engaged with the body and defining an actuation portion. The housing may be configured to sealingly engage a finish panel. A back cover may sealingly engage the housing, and a rocker may be included between the actuation portion and the back cover to transmit a force applied to the actuation portion to actuate a switch.

19 Claims, 11 Drawing Sheets

SEALED EXTERIOR SWITCH

CROSS-REFERENCE TO RELATED APPLICATIONS

The present application claims the benefit of U.S. provisional patent application Ser. No. 60/624,396, filed Nov. 2, 2004, the entire disclosure of which is incorporated herein by reference.

TECHNICAL FIELD

The present disclosure relates generally to switches, and more particularly to a switch and a sealed contact enclosure for a switch.

BACKGROUND

It is desirable for an exterior switch, e.g., an exterior vehicle switch, to withstand exposure to extreme weather conditions, abuse from a car wash, off-road activity, etc. Known switches may fail due to moisture ingress into the dry contact area of the switch. In one known configuration, a seal is established by a separate elastomeric membrane that is captured between two rigid components that combine to form a housing for the switch assembly. Screws are used to draw one rigid component toward the other, and fix the two rigid components such that they capture the elastomeric membrane. Features acting to impinge and clamp the elastomeric membrane may be added to the rigid components. The intent is to provide a watertight seal around the entire perimeter of the membrane. This approach to sealing may however be unsatisfactory, since the membrane can shift when coupled to the housing or during the assembly of the screws, thereby compromising the integrity of the seal.

BRIEF DESCRIPTION OF THE DRAWINGS

Features and advantages of the subject matter of the present disclosure will be apparent from the following description of embodiments consistent therewith, in which.

DESCRIPTION

The present disclosure is generally directed to a sealed switch assembly. Consistent with various embodiments, a sealed switch assembly may suitably be employed in connection with various automotive applications. For example, a sealed switch consistent with the present disclosure may be suitably employed for actuating the release of a lift gate, vehicle door, etc. Consistent with such applications, the switch assembly may be disposed on the exterior of the vehicle, and may therefore be exposed to the environment. It is recognized, however, that a switch consistent with the present disclosure may be suitably employed in connection with various additional applications, including applications unrelated to vehicular and/or automotive applications.

Figure 1:
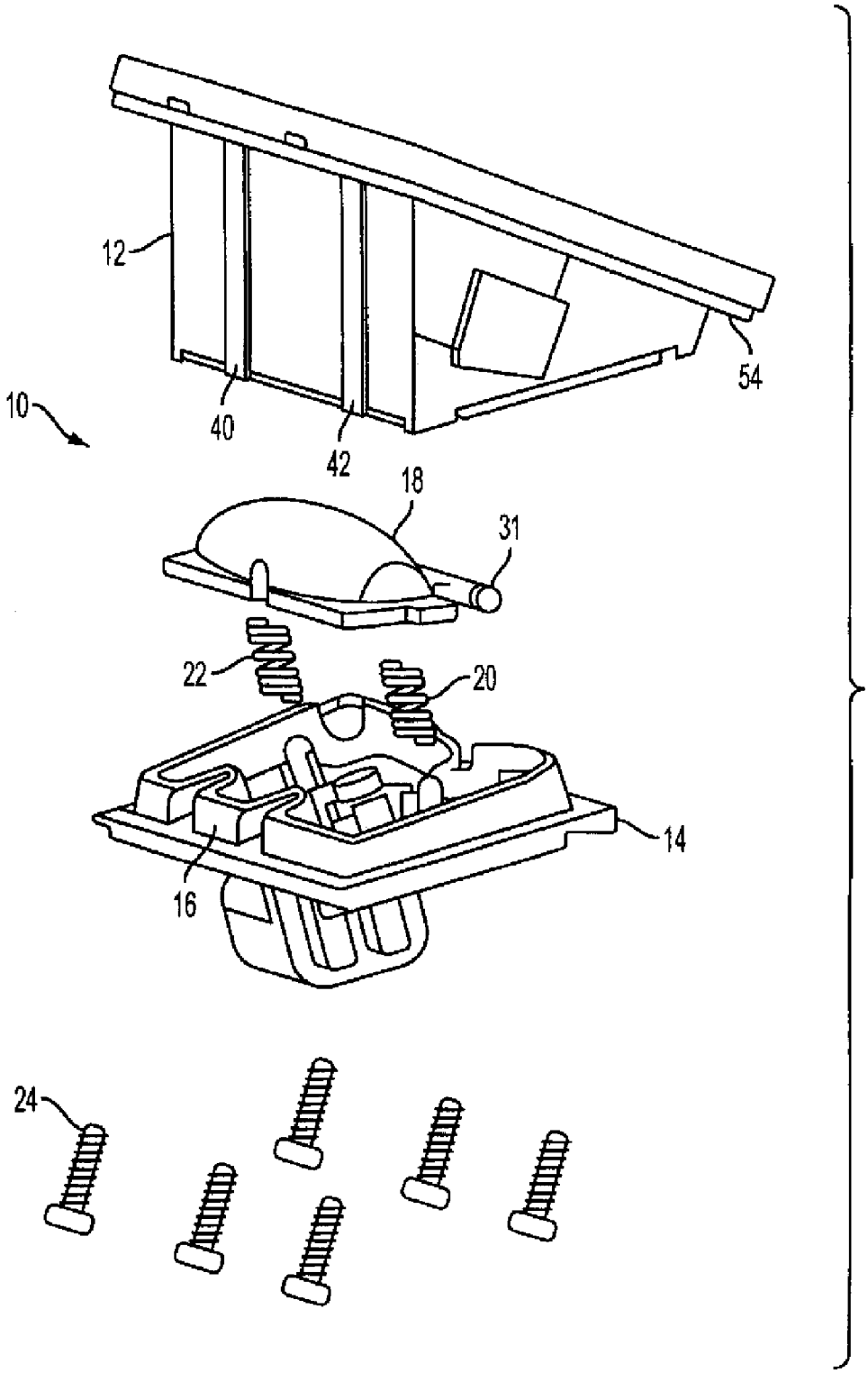
FIG. 1 is an exploded view of an embodiment of a switch assembly consistent with the present disclosure.

Referring to FIG. 1, an exploded view of an embodiment of a switch assembly 10 consistent with the present disclosure is shown. The switch assembly 10 may generally include a housing 12 and a back cover 14. The switch assembly 10 may further include a contact closure means, such as a micro-switch 16 and a rocker 18 for actuating the micro-switch, e.g., by transmitting a force to the micro-switch 16 to open or close an electrical circuit. One or more resilient features, for example springs 20, 22, may be provided to bias the rocker 18 relative to the micro-switch 16. In the illustrated embodiment the springs 20, 22 are disposed between the back cover 14 and the rocker 18 to bias the rocker away from the micro-switch 16. The back cover 14 may be configured to be coupled to the housing 12, e.g., via screws 24.

Figure 2:
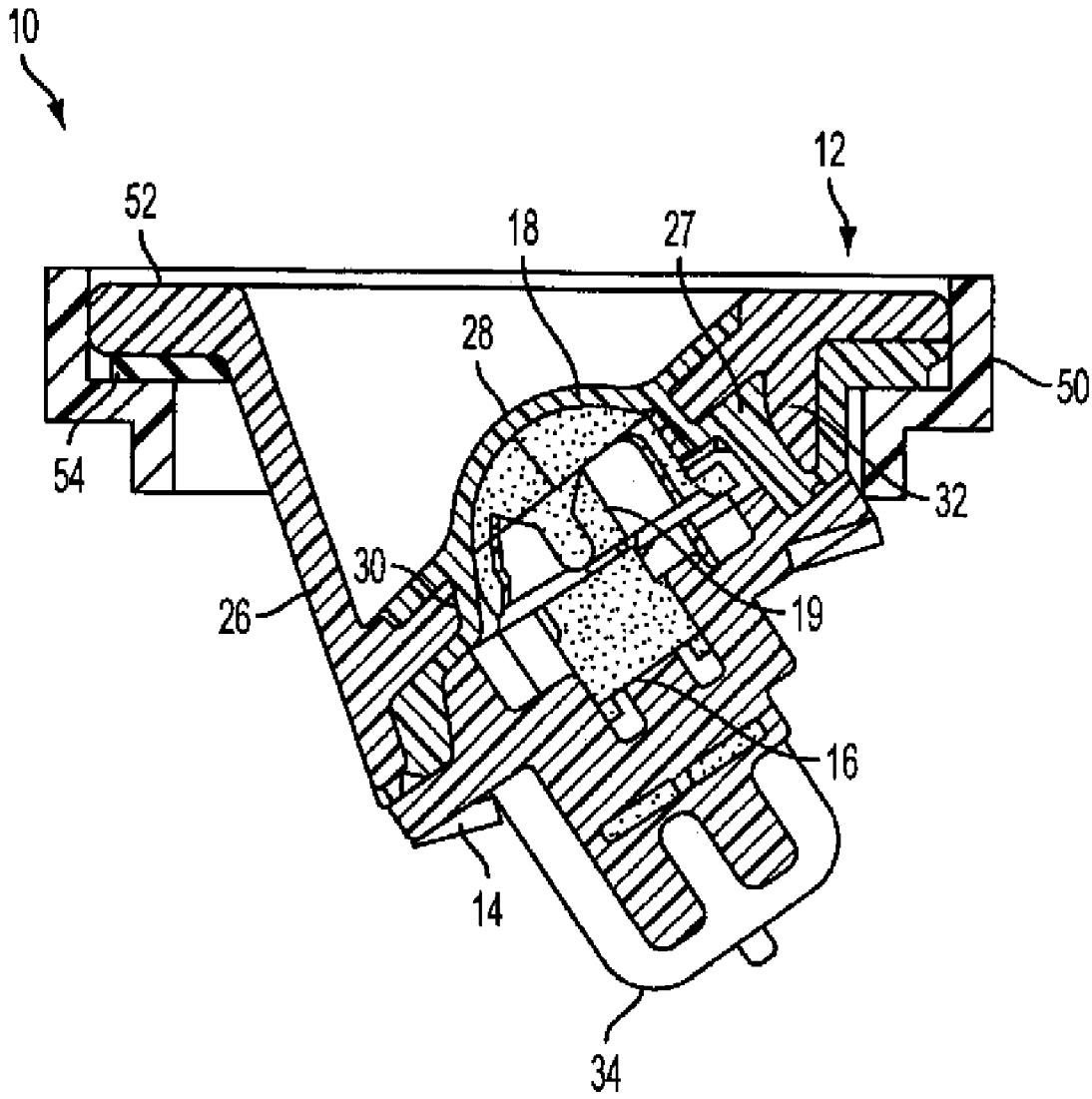
FIG. 2 is a transverse cross-sectional view of the switch assembly depicted in FIG. 1.

As shown in the transverse cross-sectional view of FIG. 2, the switch housing 12 may include a body 26 having an over-molded feature 27 overlying at least a portion of the body 26. The body 26 may be formed from a polymeric material, for example, nylon, e.g., nylon 6, nylon 6-6, polycarbonate, polypropylene, etc. The over-molded feature 27 may be an elastomeric material, such as a thermoplastic elastomer, e.g., Santoprene™. The over-molded feature 27 may include a flexible membrane disposed over at least a portion of an opening 30 defined in the body 26 and/or a surrounding region of the body 26. The flexible membrane may be sealingly engaged with said body 26 and may define at least a portion of an actuation portion 28. The over-molded feature 27 may also overlie at least a portion of a rearwardly extending wall 32 of the body 26 defining a recess.

The actuation portion 28 may provide a tactile feature, such as the illustrated convex surface. With additional reference to the longitudinal cross-sectional view of FIG. 3, the rocker 18 may be disposed in a cavity provided by the cooperation of the housing 12 and the back cover 14. The rocker 18 may have an arcuate surface generally corresponding to the tactile feature of the actuation portion 28. A force applied to the actuation portion 28 may deform the flexible membrane and the force may be transmitted via the rocker 18 to the micro-switch 16, thereby actuating the switch, i.e., changing the state of the switch, as by opening or closing an electrical connection.

The micro-switch 16 may be at least partially supported by the back cover 14, and/or may be at lest partially disposed in a recess 17 defined in the back cover 14. A connector 34 may be integrally formed with the back cover 14, e.g., via insert molding. As shown, the connector 34 may include one or more electrical contacts 36. The electrical contacts 36 may be electrically coupled to the micro-switch 16. According to one embodiment, the contacts 36 may provide mounting pads, onto which a surface mount micro-switch may be bonded. Various additional structures and/or arrangements may also, or alternatively, be used for provided for electrically coupling the micro-switch to a vehicle system, e.g., a pigtail connector.

In addition to the recess 17 for the micro-switch 16, and the connector 34, the back cover 14 may include spring locating features, such as protrusions 21, 23. The protrusions 21, 23 may locate and/or support the springs 20, 22 on the back cover 14. The back cover 14 may also include an upstanding wall 38 extending therefrom.

In one embodiment, the rocker 18 may be pivotally mounted to convert a linear actuation force applied to the actuation portion 28 into a rocking motion of the rocker 18. The rocker 18 may include a pivot feature on each end, e.g., tab 31 visible in FIG. 1. The tabs 31 may be configured to be at least partially supported by cooperating features on the back cover 14, such as support shelves 33, 35. Consistent with such an embodiment, a force applied to the rocker 18, through the actuation portion 28, may cause the rocker 18 to pivot about the tab 31 against the bias of at least one of the springs 20, 22. The pivotal movement of the rocker 18 may produce a rocking motion rather than a linear travel. As shown, the tab 31 may have a generally rounded or cylindrical shape to facilitate smooth pivoting of the rocker 18. The rocking motion of the rocker 18 may allow the actuating feature 19 of the rocker 18 to contact and actuate the micro-switch 16. The rocking motion may reduce sticking of the rocker and may provide smooth actuation of the switch, even for button geometries of a relatively long length, small width, and small depth, which may be observed in the corresponding rocker geometry. Embodiments including linear motion of the rocker are also contemplated herein.

Consistent with one embodiment, a lubricant may be provided between the over-molded feature 27 on the inside of the actuation portion 28 and the cooperating surface of the rocker 18. The lubricant between the actuation portion 28 and the rocker 18 may reduce or prevent the occurrence of slip and stick between the over-molded feature 27 and the rocker 18 during operation, e.g., when the actuation portion is depressed to actuate the switch. Reducing or preventing slip and stick between the over-molded feature and the rocker may provide a smooth operation of the switch. A variety of suitable lubricants may be used. One suitable lubricant may include a Teflon™ grease, such as a grease with small spherical Teflon™ filler particles.

The over-molded feature 27 overlying at least a portion of the body 26 of the housing 12 may be provided by molding the over-molded feature 27 directly over the body 26. The body 26 may be formed, e.g., by injection molding. The over-molded feature 27 may be over-molded onto the housing in the same molding operation. For example, the mold used for forming the body may be adjusted to provide a second cavity corresponding to the region to include the over-molded feature. A second material, e.g., an elastomer, may then be injected into the second cavity. Alternatively, the over-molded feature 27 may be over-molded onto the body 26 in a separate, e.g., a subsequent, molding operation. The material used for the over-molded feature 27 may vary in durometer and thickness to increase tear resistance and improve or adjust the tactile feel of the switch assembly 10.

In one embodiment, the over-molded feature 27 may be a low durometer thermoplastic elastomer rubber which may seal the switch from the front and along the inside walls of the housing body 26, to the rear of the switch housing 12. In this manner, the over-molded feature may, generally, provide a continuous cavity that may receive at least a portion of the rocker and may receive at least a portion of the micro-switch, enclosed by the back cover. Such a configuration may, at least in part, reduce and/or prevent the ingress of dirt and/or water.

A sealed switch assembly consistent with the present disclosure may protect the internal circuitry and/or components of the switch and the finish panel receiving the switch from the ingress of dirt and/or moisture. Consistent with various aspects of the present disclosure, one or more sealing features may be included to provide the desired protection against the ingress of dirt and/or water. As discussed above, molding the over-molded feature 27 over the housing body 26 may provide a seal between the body 26 and the actuation portion 28. The seal between the body and the actuation portion may provide uniform integrity around the entire perimeter of the actuation portion 28 and the opening 30 defined in the body 26.

According to one aspect, the switch assembly 10 may be configured to provide sealing engagement between the switch housing 12 and the back cover 14. The integrity of the seal between the housing 12 and the back cover 14 may be increased by including an elastomeric beam 44 along the perimeter of the rearwardly extending wall 32 of the body 26. As shown, e.g., in FIG. 3, the back cover 14 may at least partially overlie the elastomeric beam 44. When the back cover 14 is coupled to the housing 12, e.g., by the screws 24, the back cover 14 may be compressed against the beam 44 to provide sealing engagement between the cover 14 and the housing 12. As shown, the beam 44 may be formed as part of and/or an extension of the over-molded feature 27.

In one embodiment, the elastomeric beam 44 may be provided as a continuous feature, and may have a generally uniform thickness. To allow a beam 44 of generally uniform thickness, the housing 12 may include a boss or land around each screw hole. The screw holes may, therefore be disposed outside of the continuous beam 44. In this manner, the corresponding holes 46 in the back cover 14 may lie outside of the beam 44 when the switch assembly 10 is complete. In such an embodiment, it may not be necessary to seal the screws 24 and/or screw holes 46, as these openings may not extend into the interior of the switch assembly.

The width of the beam 44 may generally be in the range of from about 0.5 mm to about 1.5 mm. In further embodiments, the width of the beam 44 may generally be in the range from about 0.25 mm to about 10.0 mm. Various other beam widths may also be suitable. The thickness of the beam 44 may generally be in the range from about 0.5 mm to about 1.0 mm. In further embodiments, the thickness of the beam 44 may generally be in the range of from about 0.25 mm to about 3.0 mm. Other beam thicknesses may also be suitable.

The seal integrity between the back cover 14 and the housing 12 may be affected by a number of conditions and/or attributes. For example, the flatness of the housing 12 and the flatness of the back cover 14 may influence the sealing capacity. Similarly, the stiffness of the back cover 14 may affect the uniformity of the seal between the back cover 14 and the housing 12 around the perimeter of the housing 12. The durometer and thickness of the elastomeric material forming the beam 44, as well as the number of screws 24, the diameter of the screws 24, and the distance between the screws 24 may all affect the seal between the back cover 14 and the housing 12. For example, larger diameter screws may be placed further apart.

Figure 4:
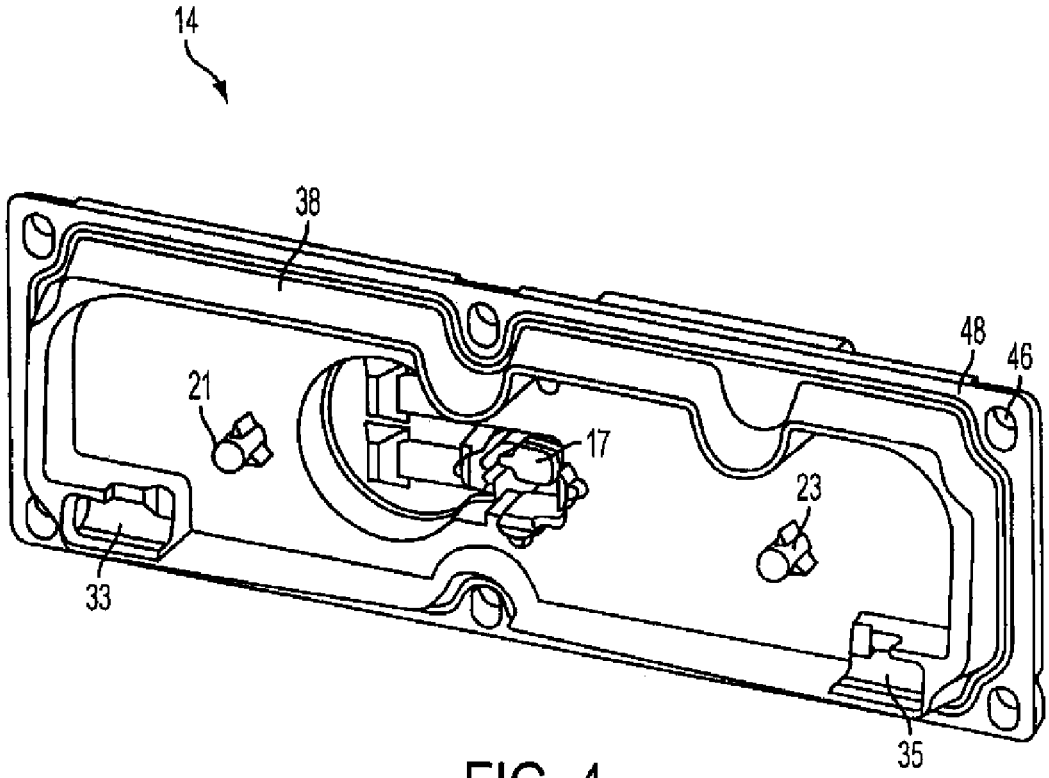
FIG. 4 is a perspective view of an embodiment of a back cover consistent with the present disclosure.
Figure 6:
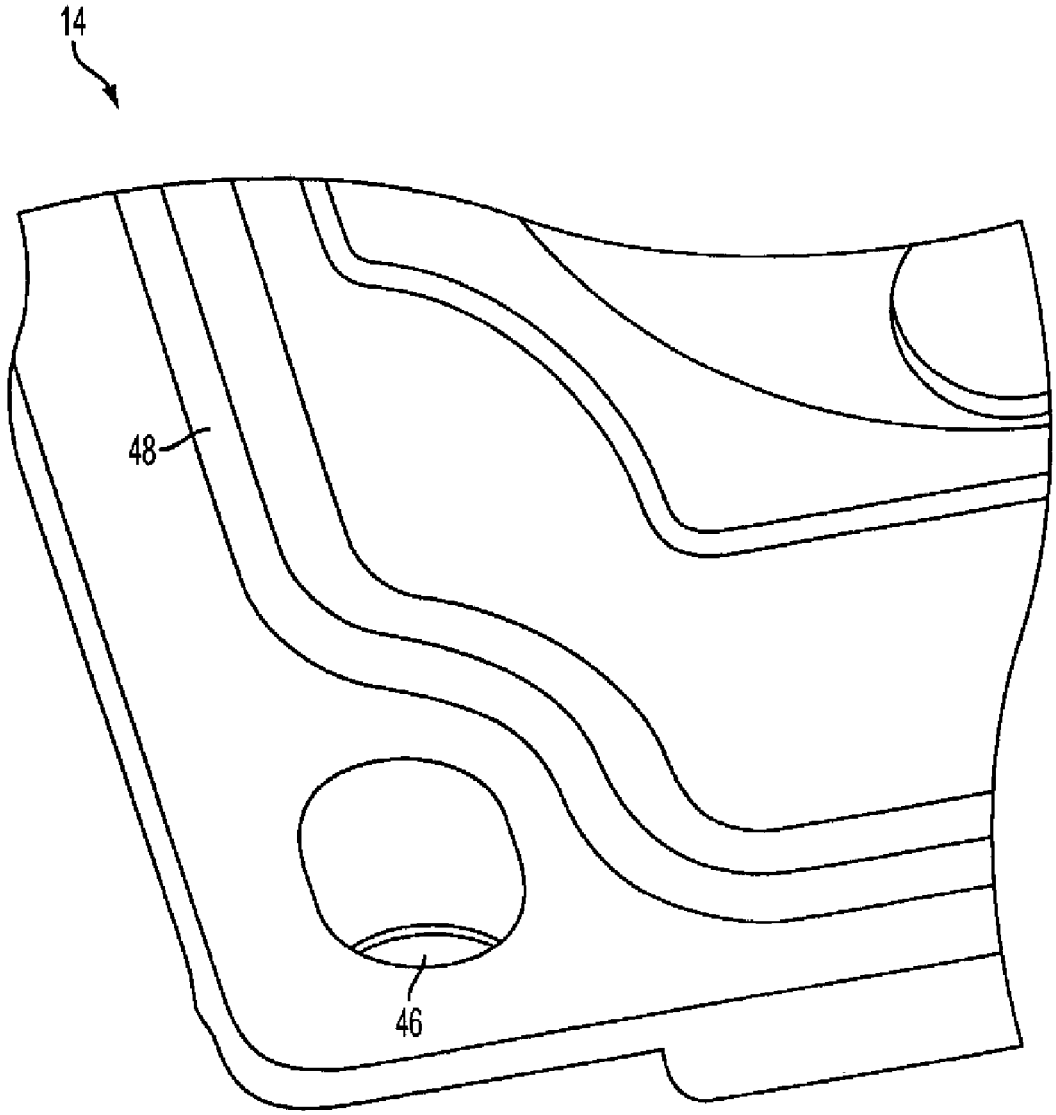
FIG. 6 is a detailed perspective view of a portion of an embodiment of a back cover consistent with the present disclosure.

The sealing capability of the back cover 14 and the housing 12 may be improved by incorporating a rib 48 into the design of the back cover 14, as shown, for example, in FIGS. 4 and 6. The rib 48 may be a continuous feature and may follow the perimeter of the beam 44 on the housing 12. According to one embodiment, the rib 48 may be positioned to generally centrally contact the beam 44 when the back cover 14 is assembled to the housing 12. When the back cover 14 is coupled to the housing 12, the rib may provide a line of concentrated stress against the beam 44. The line of concentrated stress may improve the seal between the back cover 14 and the housing 12, and may also reduce the screw clamping force necessary for creating a seal. According to an embodiment, the rib 48 may have a generally semi-circular geometry and may be sized to penetrate from about 25-50% of the thickness of the beam 44. Greater or lesser penetration of the thickness of the elastomeric beam 44 may also, in some embodiments, reduce the screw clamping force. The rib 48 may also be of different cross-section, such as triangular, rectangular, etc., and could be designed to penetrate the thickness of the beam 44 from about 10-80% to achieve a seal.

Figure 3:
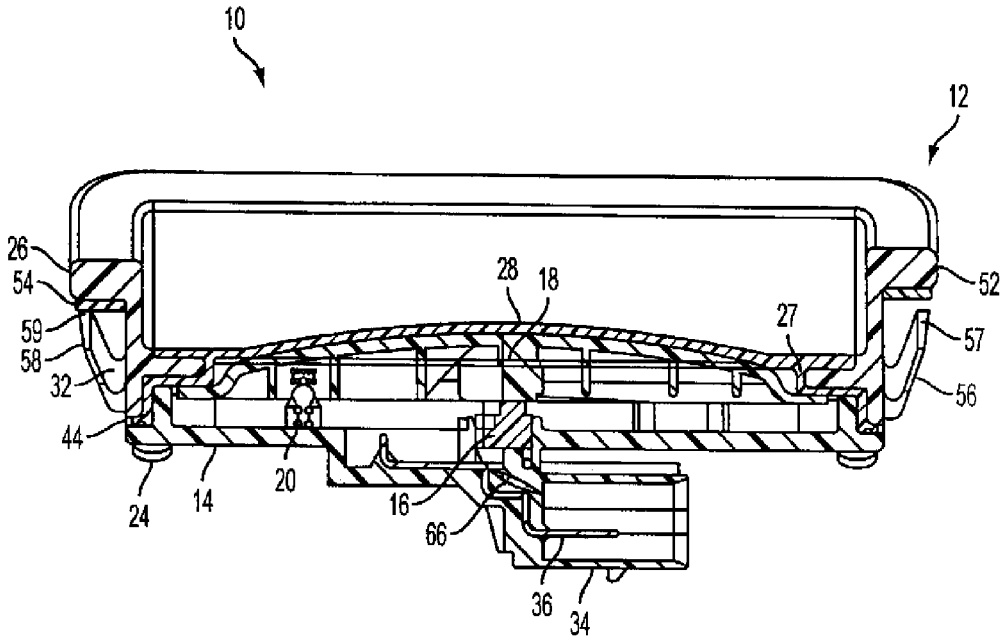
FIG. 3 is longitudinal cross-sectional view of the switch assembly depicted in FIG. 1.

According to another aspect, the switch assembly 10 may be sealed to prevent and/or reduce the ingress of dirt, water, etc. by a seal between the over-molded feature 27 and the housing body 26 at the actuation portion 28. As best shown in FIGS. 2 and 3, the actuation portion 28 may have a domed surface which may allow the over-molded feature 27 to flex during actuation of the switch with relatively little, or no, increase in the tensile stress across the surface of the actuation portion 28 and/or at the interface between the over-molded feature 27 at the actuation portion 28 and the portion of the housing body 26 defining the opening 30. The little, or no, increase in the tensile stress during actuation may reduce and/or prevent the weakening of the bond between the over-molded feature 27 and the body 26.

As also shown, the actuation portion 28 may provide a cosmetic surface, with the over-molded feature 27 overlying, and being bonded to, a portion of the body 26 defining the opening 30. The bond between the over-molded feature 27 and the body 26 may allow the elimination of exposed screws, which may not be esthetically appealing, and therefore may not be desired to create a seal across the actuation portion 28. As shown, in an embodiment consistent with the present disclosure, a relatively large flat surface may be provided around the domed feature of the actuation portion 28. The bonded surface area of the over-molded feature 27 and the body 26 around the opening 30 may be sufficient to retain the over-molded feature 27 in position and provide a seal against the ingress of dirt, water, etc.

According to another aspect, a seal may be provided between the housing 12 and a finish panel 50 into which the switch assembly 10 may be assembled. The housing 12 may include a mounting flange 52. The mounting flange 52 may include a beam 54 of elastomeric material which may extend completely around the mounting flange 52. In one embodiment, the beam 54 may extend generally the full width of the mounting flange 52. The seal between the mounting flange 52 and the finish panel 50 may be completed by fixing the switch assembly 10 to the finish panel 50. Fixing the switch assembly 10 to the finish panel 50 may at least partially compress the elastomeric beam 54 around the entire perimeter of the mounting flange 52. Features similar to the rib 48 on the back cover 14 may be included on the finish panel 50 to increase the integrity of the seal between the switch assembly 10 and the finish panel 50, e.g., by creating a line of concentrated stress. Cooperating screw features may also be added to both the switch assembly 10 and to the finish panel 50 to increase the integrity of the seal.

In one embodiment, the elastomeric beam 54 included on the mounting flange 52 may be formed as an over-molded feature. In such an embodiment the elastomeric beam may be bonded to the housing body 26 as a result of the over-molding operation. In one particular embodiment, the elastomeric beam 54 may be formed from the same material as the over-molded feature 27. Furthermore, the elastomeric beam 54 may be formed as part of the over-molding operation during which the over-molded feature 27 is over-molded on the housing body 26. The body 26 may include one or more feed runners 40, 42, which may permit the flow of the elastomeric material from the region of the over-molded feature 27 during over-molding operation to form the elastomeric beam 54. The feed runners 40, 42 may include channels formed in the body 26 that may be filled with the elastomeric material during an over-molding operation.

Figure 5:
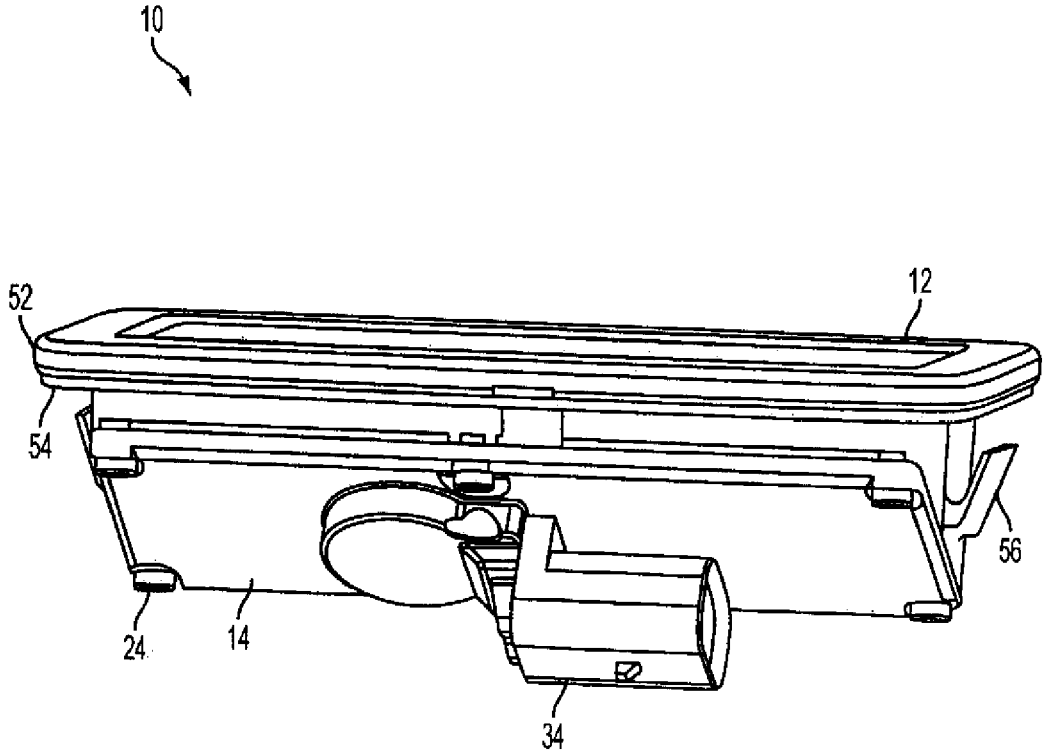
FIG. 5 is a rear perspective view of the switch assembly depicted in FIG. 1.
Figure 7:
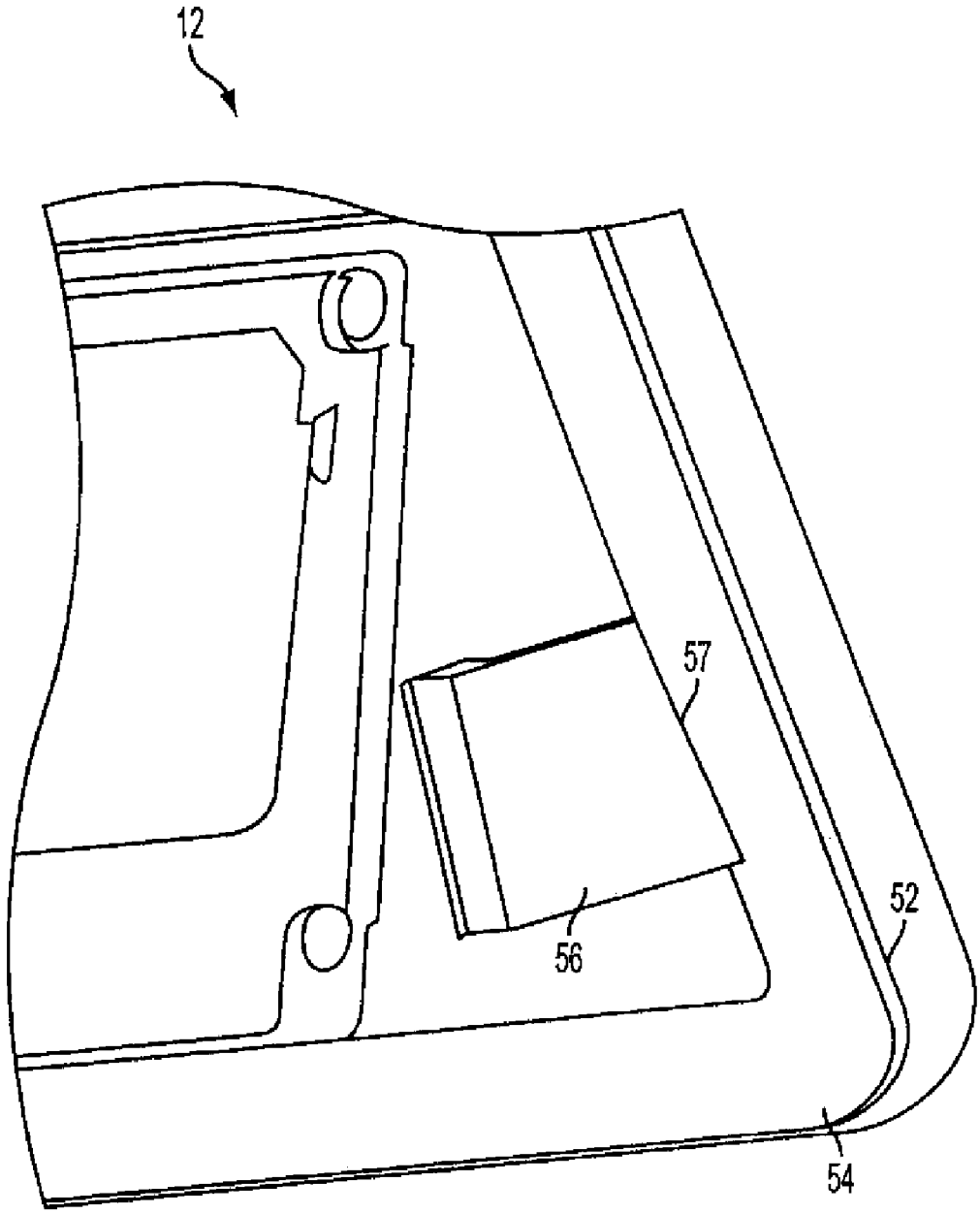
FIG. 7 is a detailed perspective view of a portion of an embodiment of a housing consistent with the present disclosure.

With particular reference to FIGS. 3 and 5, in one embodiment the switch assembly 10 may include one or more latch features 56, 58 for coupling the housing and/or the switch assembly to a finish panel. The latch features 56, 58 may be integrally formed with the housing 12. One latch feature 56, 58 may be disposed at each of two opposing sides of the switch assembly 10. As shown, e.g., in FIG. 2, the plane of the actuation portion 28 may not be parallel to the mounting flange 52. However, the latching edge 57, 59 of the latch features 56, 58 may be oriented generally parallel to the mounting flange 52. An injection molding operation for forming the housing 12 may be constrained by the direction which the mold components move during a standard molding operation. Standard side-actions for the molding operation may be designed to move generally normal, or perpendicular, to the standard direction of movement of the mold components. Consistent with such an embodiment, the latch features 56, 58 may be designed to facilitate manufacture using standard side-actions, and thereby eliminate the cost of angular side-actions. In such an embodiment, the length of the latch features 56, 58 may vary from one end to the other, as shown in FIG. 7. To allow the latching edge 57, 59 of the latch features 56, 58 to translate parallel to the surface of the housing 12 to which they are attached, the thickness of the latch features 56, 58 may be tapered from one edge to the other, i.e., the longer edge of the latch features 56, 58 may be thicker than the shorter edge.

Figure 8:
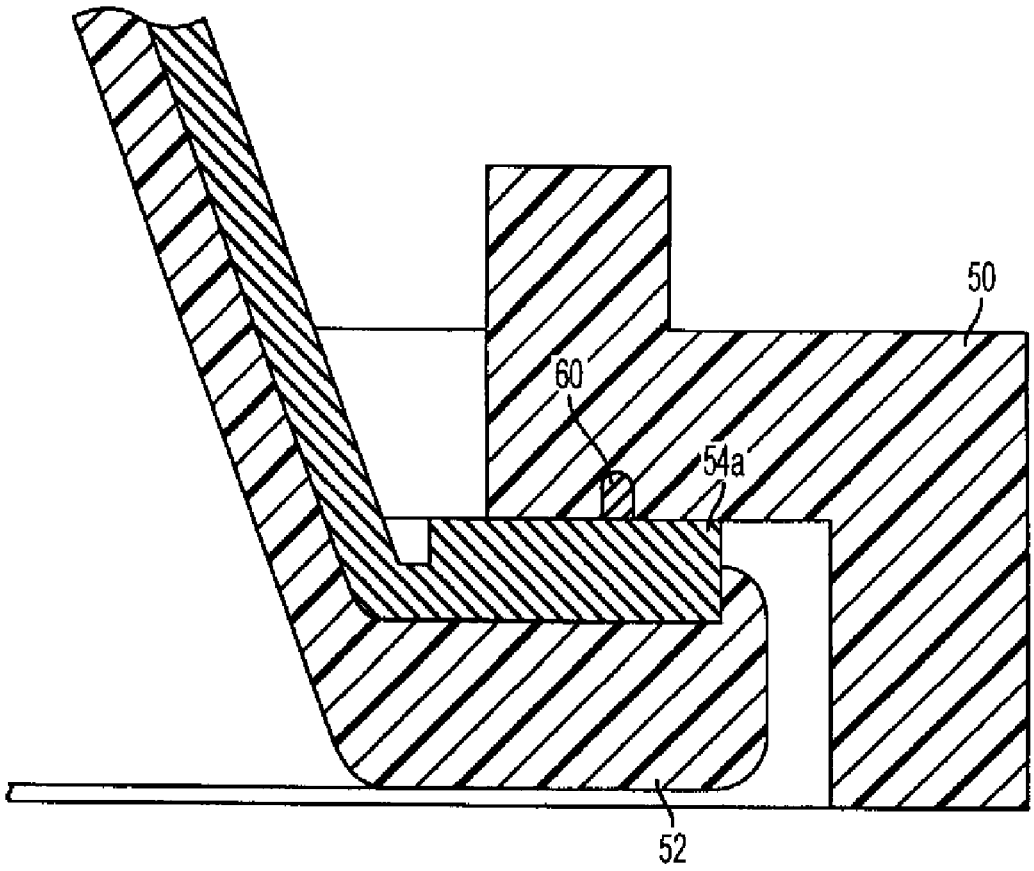
FIG. 8 is a detailed cross-sectional view of a portion of an embodiment of a housing consistent with the present disclosure.
Figure 9:
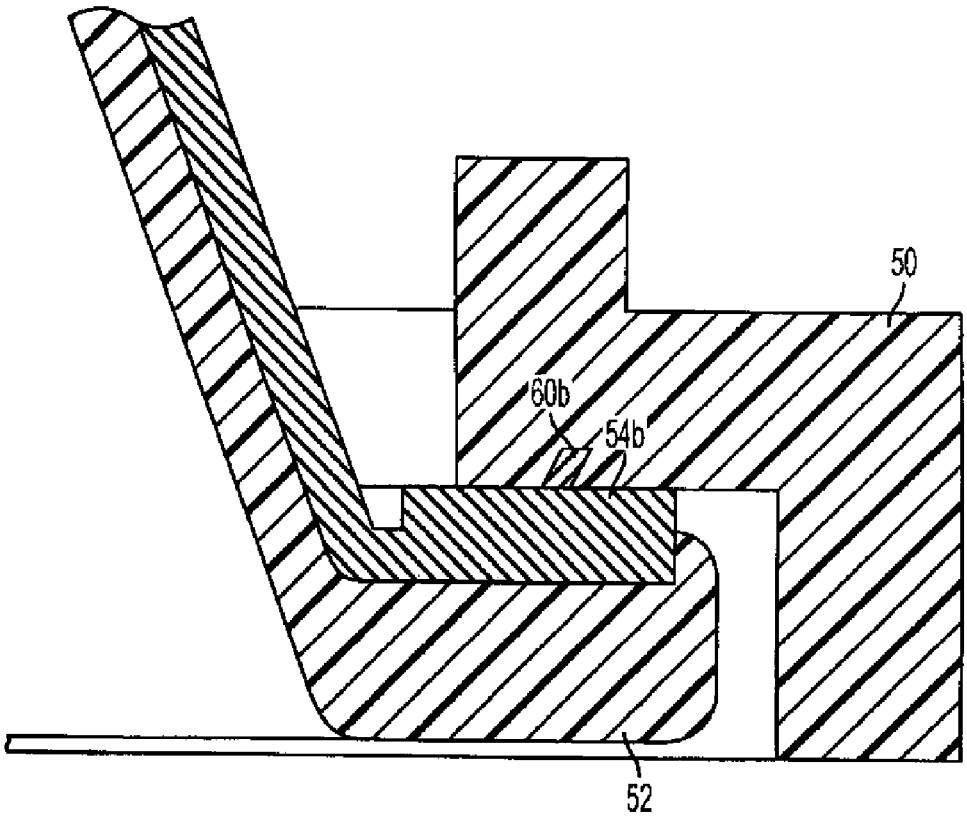
FIG. 9 is a detailed cross-sectional view of a portion of another embodiment of a housing consistent with the present disclosure.

As mentioned above, the finish panel 50 may include a bead configured to engage the beam 54, which may increase the seal integrity, e.g., by creating a line of concentrated stress between the finish panel and the beam 54. In additional embodiments, the finish panel and/or the mounting flange 52 or beam 54 may include various features which may improve the seal between the finish panel 50 and the switch assembly 10. As shown in FIGS. 8 and 9, the seal may be improved by incorporating another sealing feature into the elastomeric beam 54*a*, 54*b*, which is located on the surface of the mounting flange 52. As shown, a flap 60*a*, 60*b* may be provided extending from the beam 54*a*, 54*b*. In one embodiment, the flap 60*a* may be oriented extending generally normal from the beam 54*a*. In another embodiment, the flap 60*b* may be oriented extending from the beam 54*b* at an angle. In either configuration, the flap 60*a*, 60*b* may be integrally formed with the beam 54*a*, 54*b* during the over-molding operation. A housing consistent with the present disclosure may be provided including both an angled flap and a normal flap. An angled flap 60*b* may be utilized on areas of a beam 54*b* where a side-action in the mold may allow a mold component to engage and disengage with the flap 60*b* to facilitate molding. On areas of a beam 54*a* where a side-action is not as easily utilized, a flap 60*a* extending generally normal to the flange 54*a* may be provided. In such an embodiment, the angled and normal flaps may be connected around the perimeter of the beam depending upon mold design and the convenience and/or desired use of side-actions.

As mentioned, the housing 12 and/or at least some of the sealing surfaces described herein may be produced by a single over-molding operation, in which the housing body 26 may be molded from a first material and a second, e.g., elastomeric, material may be molded to overlie at least a portion of the body 26 to provide the over-molded feature. In one embodiment, the gate for injecting the elastomeric material may be located on the outer surface of the body 26, e.g., a gate may be located on one or both of the feed runners 40, 42. The feed runners 40, 42 may allow the elastomer to flow to the sealing surface of the mounting flange 52, e.g., to form the beam 54. During molding of the over-molded feature 27, the feed runners 40, 42 may also allow the elastomer to flow into the inner surface of the body 26 to form the actuation portion 28, overlie at least a portion of the inner surface of the rearwardly extending wall 32, and form the beam 44 along the perimeter of the rearwardly extending wall 32 of the body 26.

In one embodiment the thickness of the region of the over-molded feature 27 overlying the inner surface of the rearwardly extending wall 32 may be sized to permit the back cover 14 to be assembled to the housing 12 with minimal force. According to some embodiments, the back cover 14 may engage the housing 12 and remain engaged with the housing 12 during subsequent operations of the assembly operation, for example until the screws 24 are assembled. In one such embodiment, the dimensions of the over-molded feature 27 overlying the inner surface of the rearwardly extending wall 32 may be sized to engaged the upstanding wall 38 of the back cover 14, e.g., and frictionally retain the back cover 14 to the housing 12. Another alternative may include providing a mismatch between the mating radii that extend around the perimeter of the back cover 14 and the housing 12, i.e., a radius on the housing may be smaller than the mating radius on the back cover 14. The mismatch in the mating radii may result in an at least partial interference and a seal between the two radii.

Various alternative structures and/or techniques may be employed to achieve one or more of the seals discussed herein. For example, the seal between the back cover and the housing may include ultrasonic welding of the two components to achieve a seal to prevent and/or reduce the ingress of dirt and/or water. Similarly, the back cover may be bonded to the housing, e.g., via adhesive bonding, solvent bonding, etc. Since alternative techniques for sealing the back cover and the housing may not require an elastomeric material to provide the seal the elastomeric material, e.g., the beam around the perimeter of the rearwardly extending wall, may not be required between the housing and the back cover.

Figure 10:
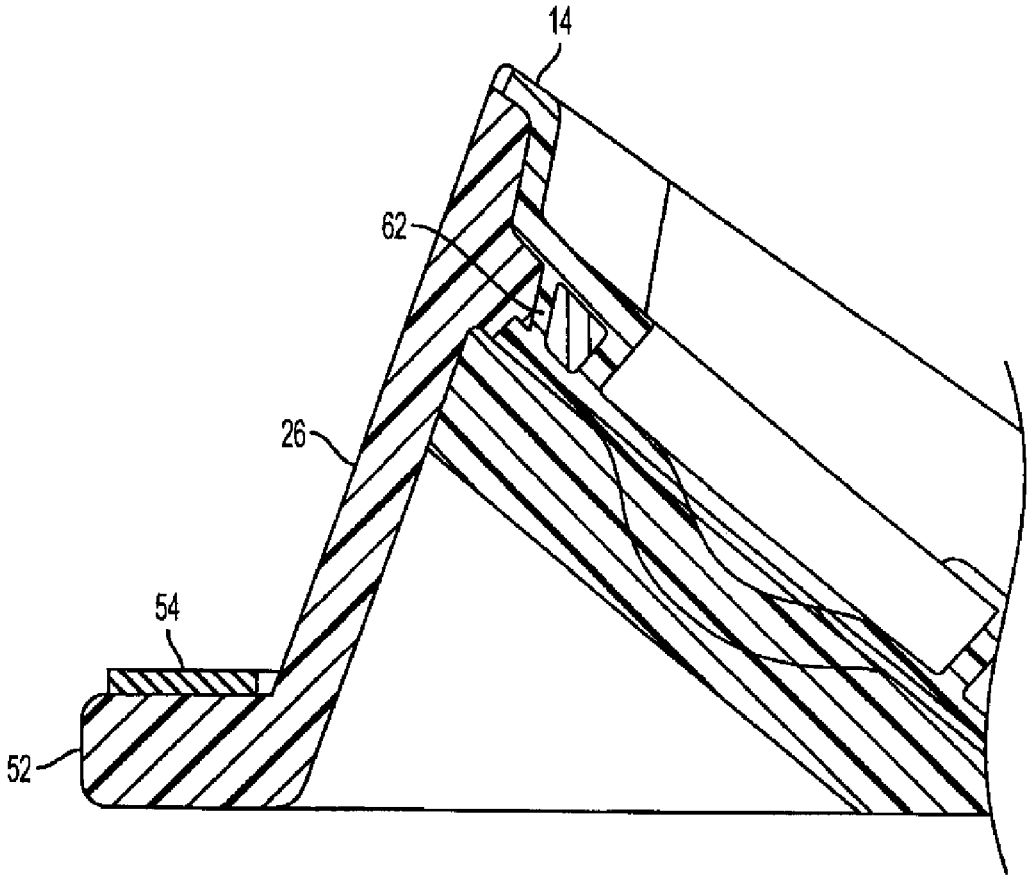
FIG. 10 is a detailed cross-sectional view of a portion of another embodiment of a housing consistent with the present disclosure.

The tear resistance of the over-molded feature at the actuation portion may be varied according to particular applications. For example the tear resistance may be increased by increasing the thickness of the material at the actuation portion and/or by increasing the durometer of the elastomer. The tear resistance of the over-molded feature at the actuation portion may further be increased by incorporating flexible tear resistant feature. For example, the over-molded feature may incorporate a flexible mesh at the actuation portion. The flexible mesh may, in some embodiments, be incorporated as part of the over-molding operation. According to another aspect, the bond between the elastomeric material, e.g., of the over-molded feature 27 and the housing body 26, may be increased by incorporating cross-holes 62 or cavities to create three-dimensional mechanical interlocks between the over-molded feature 27 and the body 26, as shown in FIG. 10. Similar features may be used to increase the bond strength between the elastomeric material and the body at and/or along any of the elastomeric beams. In a related manner, the bond between the elastomeric material and the body may be increased by modifying the texture of the mating surface on the body. While these aspects may be advantageous, they are not considered essential to the present disclosure.

Figure 11:
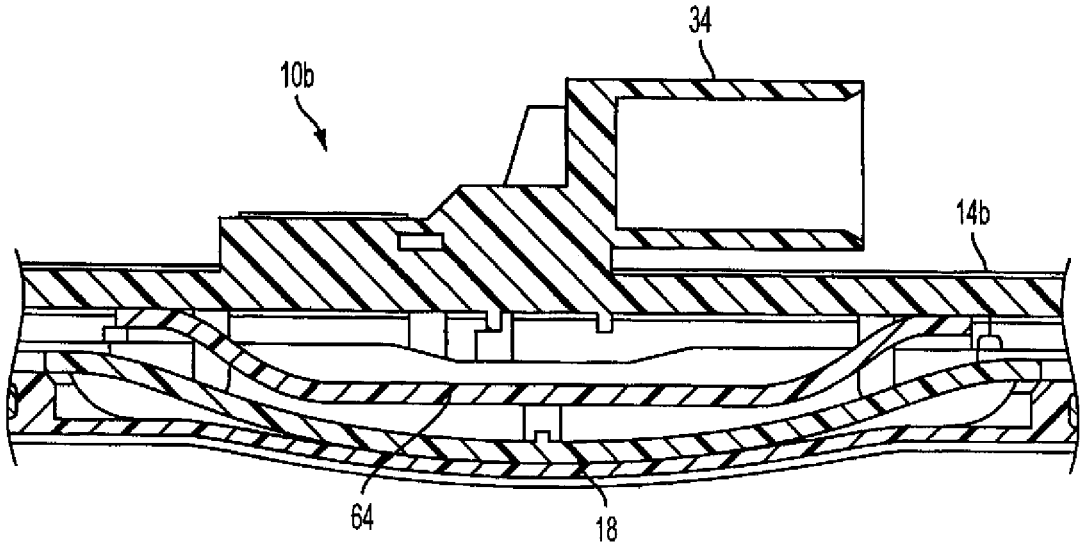
FIG. 11 is a partial cross-sectional view of an embodiment of a switch assembly including a leaf spring contact consistent with the present disclosure.

Consistent with a previously discussed embodiment, compression springs may be used to bias the rocker toward a neutral position, i.e., toward the actuation portion and in which the micro-switch is in an open condition. Referring to FIG. 11, consistent with another embodiment, a switch assembly **10*b* may be provided in which the plurality of springs and the micro-switch may be replaced, for example, by a single leaf spring 64. The leaf spring 64 may be resiliently deformable by the rocker 18 toward the back cover 14*b*. The contacts from the connector 34 may provide contact pads for an electrically conductive leaf spring 64. The switch may be actuated, i.e., the circuit closed, by resiliently deforming the electrically conductive leaf spring 64 to complete the circuit between the contact pads provided by the contacts extending from the connector 34**. Various other embodiments and configurations may also suitably be employed consistent with the present disclosure.

A switch assembly consistent with the present disclosure may be completely sealed, and therefore a volume of air may be trapped within the switch assembly. Automotive industries standards require the switch to operate properly between the temperatures of −40 C. and +85 C. During actuation at elevated temperatures, the volume of air may generate an increase in pressure within the switch that could compromise seal integrity. According to one embodiment, an increase in pressure may be avoided by creating a pathway or a hole for air to escape. A relief hole 66, as contemplated herein, may be placed in the connector 36, as depicted in FIG. 3. In such an embodiment the capability to relieve internal pressure may be limited since mating connectors used for these applications form a seal with the connector 36. According to another embodiment, a through-hole may be incorporated into the housing. The through hole may be covered and/or filled with a permeable moisture barrier that may allow air flow but may inhibit moisture ingress into the switch. Both of these options for pressure relief may also provide an opening for leak testing the assembled switch.

Therefore, according to one aspect, a switch assembly is provided including a housing having a body and an over-molded feature. The over-molded feature may include a flexible membrane sealing engaged with the body and defining an actuation portion. The housing may be configured to sealingly engage a finish panel. The switch assembly may also include a back cover that is configured to be sealingly coupled to the housing. Additionally, the switch assembly may include a rocker disposed between at least a portion of the actuation portion of the housing and the back cover. The rocker may transmit a force applied to the actuation portion to actuate a switch.

According to another aspect, the present disclosure may provide a sealed switch assembly including a housing having a body and an over-molded feature. The over-molded feature may include a flexible membrane defining at least a portion of an actuation portion. The over-molded feature may also define a sealing beam around at least a portion of a perimeter of a rearwardly extending wall of the body. The sealed switch assembly may also include a back cover that is configured to sealing engage the housing via the sealing beam. The back cover may also include a micro-switch that is at least partially supported by the back cover. A rocker may be pivotally disposed between at least a portion of the actuation portion and at least a portion of the back cover.

According to yet another aspect, a sealed switch assembly is provided including a body having a rearwardly extending wall, and opening, and a mounting flange. An over-molded feature includes a flexible membrane sealing engaged with the body and disposed over at least a portion of the opening. The flexible membrane may define at least a portion of an actuation portion. The over-molded feature may also include a first beam disposed around a perimeter of the rearwardly extending wall and may also include a second beam disposed around the mounting flange. A back cover may include a recess and a micro-switch at least partially disposed in the recess. The back cover may be configured to be sealingly coupled to the body via the first beam. The switch assembly may also include a rocker disposed between at least a portion of the actuation portion and at least a portion of the back cover. The rocker may be pivotally mounted to transmit an actuating force from the actuation portion to the micro-switch.

It should also be understood that the various features and aspects of the exemplary switch assemblies described herein may be combined with one another. Furthermore, the features and aspects of the invention herein are susceptible to use with other switch assemblies in addition to the exemplary assemblies.

The embodiments that have been described herein are but some of the several which utilize this invention and are set forth here by way of illustration, but not of limitation. It is obvious that many other embodiments, which will be readily apparent to those skilled in the art may be made without departing materially from the spirit and scope of the invention.

What is claimed is:

1. A switch assembly comprising:

a housing comprising a body and an over-molded feature comprising a flexible membrane sealingly engaged with said body and defining an actuation portion; said housing configured to sealingly engage a finish panel;

a back cover configured to be sealing coupled to said housing;

a rocker disposed between at least a portion of said actuation portion and said back cover, said rocker configured to transmit a force applied to said actuation portion to actuate a switch, wherein said body comprises a rearwardly extending wall, and said over-molded feature comprises an elastomeric beam configured to be disposed between said rearwardly extending wall and said back cover with said back cover compressed against said elastomeric beam around a perimeter of said housing to provide a seal between said back cover and said housing.

2. A switch assembly according to claim 1, wherein said over-molded feature comprises an elastomeric material over-molded onto said body.

3. A switch assembly according to claim 1, wherein said housing comprises a mounting flange comprising an elastomeric beam configured to sealingly engage said finish panel.

4. A switch assembly according to claim 1, wherein said rocker is pivotally mounted relative to said housing.

5. A switch assembly according to claim 4, wherein said rocker comprises at least one pivot tab configured to be pivotally supported by said back cover.

6. A switch assembly according to claim 1, wherein said switch comprises a micro-switch disposed between at least a portion of said rocker and at least a portion of said back cover, said rocker being configured to actuate said micro-switch.

7. A sealed switch assembly comprising:

a housing comprising a body and an over-molded feature, said over-molded featured comprising a flexible membrane defining at least a portion of an actuation portion, said over-molded feature further defining a sealing beam around at least a portion of a perimeter of a rearwardly extending wall of said body;

a back cover configured to sealingly engage said housing via said sealing beam with said sealing beam disposed between said rearwardly extending wall and said back cover with said back cover compressed against said sealing beam around a perimeter of said housing to provide a seal between said back cover and said housing, said back cover comprising a micro-switch at least partially supported by said back cover; and a rocker pivotally disposed between at least a portion of said actuation portion and at least a portion of said back cover.

8. A sealed switch assembly according to claim 7, wherein said over-molded feature comprises an elastomeric material.

9. A sealed switch assembly according to claim 7, wherein said housing further comprises a mounting flange, and wherein said over-molded feature further comprises a second sealing beam defined around at least a portion of the perimeter of said mounting flange.

10. A sealed switch assembly according to claim 9, wherein said second sealing beam comprises flap extending from said second beam, said flap configured to sealingly engage at least a portion of a finish panel.

11. A sealed switch assembly according to claim 7, said assembly further comprising a lubricant disposed between said actuation portion and said rocker.

12. A sealed switch assembly according to claim 7, wherein said back cover comprises a rib configured to sealing engage said sealing beam of said housing.

13. A sealed switch assembly comprising:

a housing comprising a body and an over-molded feature, said over-molded featured comprising a flexible membrane defining at least a portion of an actuation portion, said over-molded feature further defining a sealing beam around at least a portion of a perimeter of a rearwardly extending wall of said body;

a back cover configured to sealingly engage said housing via said sealing beam with said sealing beam disposed between said rearwardly extending wall and said back cover, said back cover comprising a micro-switch at least partially supported by said back cover; and a rocker pivotally disposed between at least a portion of said actuation portion and at least a portion of said back cover, wherein said back cover comprises a rib configured to sealingly engage said sealing beam of said housing.

14. A sealed switch assembly comprising:

a body comprising a rearwardly extending wall, an opening, and a mounting flange;

an over-molded feature comprising a flexible membrane sealingly engaged with said body and disposed over at least a portion of said opening and defining at least a portion of an actuation portion and defining a first beam disposed around a perimeter of said rearwardly extending walit and a second beam disposed around said mounting flange;

a back cover comprising a recess and a micro-switch at least partially disposed in said recess, said back cover configured to sealingly couple to said body via said first beam with said first beam disposed between said rearwardly extending wall and said back cover with said back cover compressed against said first beam around a perimeter of said housing to provide a seal between said back cover and said housing; and a rocker disposed between at least a portion of said actuation portion and at least a portion of said back cover, said rocker pivotally mounted to transmit an actuating force from said actuation portion to said micro-switch.

15. A sealed switch assembly according to claim 14, further comprising at least one spring disposed between said back cover and said rocker, said spring biasing said rocker toward said actuation portion.

16. A sealed switch assembly according to claim 14, wherein said back cover further comprises a rib configured to sealingly engage said first beam.

17. A sealed switch assembly according to claim 14, wherein said body comprises at least one latching feature configured to coupled said body to a finish panel.

18. A sealed switch assembly comprising:

a body comprising a rearwardly extending wall, an opening, and a mounting flange;

an over-molded feature comprising a flexible membrane sealingly engaged with said body and disposed over at least a portion of said opening and defining at least a portion of an actuation portion and defining a first beam disposed around a perimeter of said rearwardly extending wall and a second beam disposed around said mounting flange;

a back cover comprising a recess and a micro-switch at least partially disposed in said recess, said back cover configured to sealingly couple to said body via said first beam with said first beam disposed between said rearwardly extending wall and said back cover; and a rocker disposed between at least a portion of said actuation portion and at least a portion of said back cover, said rocker pivotally mounted to transmit an actuating force from said actuation portion to said micro-switch, wherein said back cover further comprises a rib configured to sealingly engage said first beam.

19. A sealed switch assembly according to claim 18, wherein said body comprises at least one latching feature configured to coupled said body to a finish panel.

* * * * *